US007926590B2

(12) United States Patent
Eriksen et al.

(10) Patent No.: US 7,926,590 B2
(45) Date of Patent: Apr. 19, 2011

(54) METHOD OF LINER DRILLING AND CEMENTING UTILIZING A CONCENTRIC INNER STRING

(75) Inventors: Erik P. Eriksen, Calgary (CA); Michael Brouse, Houston, TX (US)

(73) Assignee: Tesco Corporation, Houston, TX (US)

( * ) Notice: Subject to any disclaimer, the term of this patent is extended or adjusted under 35 U.S.C. 154(b) by 171 days.

(21) Appl. No.: 12/347,443

(22) Filed: Dec. 31, 2008

(65) Prior Publication Data

US 2009/0107675 A1 Apr. 30, 2009

Related U.S. Application Data

(63) Continuation-in-part of application No. 12/238,191, filed on Sep. 25, 2008, now Pat. No. 7,784,552.

(51) Int. Cl.
*E21B 23/02* (2006.01)

(52) U.S. Cl. ..... 175/57; 175/171; 166/380; 166/208

(58) Field of Classification Search ..... 175/57, 175/171; 166/380, 208
See application file for complete search history.

(56) References Cited

U.S. PATENT DOCUMENTS

| | | | |
|---|---|---|---|
| 3,163,238 | A | 12/1964 | Malott |
| 5,074,366 | A | 12/1991 | Karlsson et al. |
| 5,425,423 | A | 6/1995 | Dobson et al. |
| 5,957,225 | A | 9/1999 | Sinor |
| 6,095,261 | A | 8/2000 | Trevino, Jr. |
| 6,138,774 | A | 10/2000 | Bourgoyne, Jr. et al. |
| 6,412,574 | B1 | 7/2002 | Wardley et al. |
| 6,543,552 | B1 | 4/2003 | Metcalfe et al. |
| 6,739,398 | B1 | 5/2004 | Hokley |
| 6,742,606 | B2 | 6/2004 | Metcalfe et al. |
| 6,854,533 | B2 | 2/2005 | Galloway et al. |
| 6,857,487 | B2 | 2/2005 | Galloway et al. |
| 6,899,186 | B2 | 5/2005 | Galloway et al. |
| 7,013,997 | B2 | 3/2006 | Vail, III |
| 7,036,610 | B1 | 5/2006 | Vail, III |

(Continued)

FOREIGN PATENT DOCUMENTS

CA 2538196 8/2006

(Continued)

OTHER PUBLICATIONS

Weatherford "R Running Tool with Hydraulically Released Mechanical Lock", 2006, pp. 1-2.

(Continued)

*Primary Examiner* — William P Neuder
*Assistant Examiner* — Catherine Loikith
(74) *Attorney, Agent, or Firm* — Bracewell & Giuliani LLP

(57) ABSTRACT

A method of drilling a well and installing a liner includes assembling concentric inner and outer strings of tubulars. A drill bit is located at the lower end of the inner string and a liner with a liner hanger makes up part of the outer string. The inner and outer strings may be rotated in unison to drill the well. At a selected depth, the operator sets the liner hanger and retrieves the inner string. The operator lowers a packer and a cement retainer on a string of conduit. The packer engages the liner hanger and the cement retainer is conveyed to the lower end of the liner. The cement retainer prevents cement in the outer annulus from flowing back up the string of conduit. The operator manipulates the conduit to set the packer.

24 Claims, 10 Drawing Sheets

U.S. PATENT DOCUMENTS

| | | | | |
|---|---|---|---|---|
| 7,040,420 | B2 | 5/2006 | Vail, III | |
| 7,048,050 | B2 | 5/2006 | Vail, III et al. | |
| 7,083,005 | B2 | 8/2006 | Galloway et al. | |
| 7,093,675 | B2 | 8/2006 | Pia | |
| 7,100,710 | B2 | 9/2006 | Vail, III | |
| 7,108,080 | B2 | 9/2006 | Tessari et al. | |
| 7,108,084 | B2 | 9/2006 | Vail, III | |
| 7,117,957 | B2 | 10/2006 | Metcalfe et al. | |
| 7,147,068 | B2 | 12/2006 | Vail, III | |
| 7,165,634 | B2 | 1/2007 | Vail, III | |
| 7,225,880 | B2 | 6/2007 | Braddick | |
| 7,228,901 | B2 | 6/2007 | Vail, III | |
| 7,234,542 | B2 | 6/2007 | Vail, III | |
| 7,311,148 | B2 | 12/2007 | Giroux et al. | |
| 7,334,650 | B2 | 2/2008 | Giroux et al. | |
| 7,360,594 | B2 | 4/2008 | Giroux | |
| 2001/0017210 | A1 | 8/2001 | Howlett | |
| 2004/0221997 | A1 * | 11/2004 | Giroux et al. | 166/380 |
| 2005/0103525 | A1 | 5/2005 | Sangesland | |
| 2006/0196695 | A1 | 9/2006 | Giroux et al. | |
| 2007/0007014 | A1 | 1/2007 | Sessions et al. | |
| 2007/0175665 | A1 | 8/2007 | Tessari et al. | |
| 2007/0267221 | A1 | 11/2007 | Giroux et al. | |
| 2009/0090508 | A1 | 4/2009 | Brouse | |
| 2009/0101345 | A1 | 4/2009 | Moffitt et al. | |

FOREIGN PATENT DOCUMENTS

| | | | |
|---|---|---|---|
| WO | WO2007/011906 | A1 | 1/2007 |

OTHER PUBLICATIONS

Drilling Contractor "Liner Drilling Technology Being Prepared for Offshore", Jan./Feb. 2004, pp. 14-15.

Dril-Quip LS-15 Liner Hanger System, Sales Manual, pp. 5-7.

TIW "Liner Equipment" HLX Liner-Top Packer, pp. 5, 9-11, 18-19.

Dril-Quip "LS-15 Liner Hanger System", pp. 1-2, 4 and 6.

World Oil/Oct. 1999—Drilling Technology "Casing-While-Drilling: The Next Step Change in Well Construction", pp. 34-36 and 38-40.

Rotary Steerable Drilling with Liner—during 2007 or later based on the text—Randi Elisabeth Hugdahl, Leader, TNE RD RCT DWPT—pp. 3-5.

Drilling Liner Technology for Depleted Reservoir C. Vogt, SPE and F. Makohl, SPE, Baker Hughes INTEQ; P. Suwarno, SPE and B. Quitzau, SPE, Mobil Oil Indonesia—SPE 36827—PP. 127-132.

Simultaneous Drill and Case Technology—Case Histories, Status and Options for Further Development, by Detlef Hahn, Baker Hughes Inteq, Wilhelmus Van Gestel, BP Amoco Norway AS, Norbert Frohlich, Baker Hughes Inteq, Glenn Stewart, Baker Hughes Inteq—SPE International, IADC/SPE 59126, Feb. 23-25, 2000, pp. 1-9.

* cited by examiner

METHOD OF LINER DRILLING AND CEMENTING UTILIZING A CONCENTRIC INNER STRING

CROSS-REFERENCE TO RELATED APPLICATION

This application is a continuation-in-part of Ser. No. 12/238,191, filed Sep. 25, 2008, which claimed priority to provisional application Ser. No. 60/977,263, filed Oct. 3, 2007.

FIELD OF THE INVENTION

This invention relates in general to oil and gas well drilling while simultaneously installing a liner in the well bore.

BACKGROUND OF THE INVENTION

Oil and gas wells are conventionally drilled with drill pipe to a certain depth, then casing is ran and cemented in the well. The operator may then drill the well to a greater depth with drill pipe and cement another string of casing. In this type of system, each string of casing extends to the surface wellhead assembly.

In some well completions, an operator may install a liner rather than an inner string of casing. The liner is made up of joints of pipe in the same manner as casing. Also, the liner is normally cemented into the well. However, the liner does not extend back to the wellhead assembly at the surface. Instead, it is secured by a liner hanger to the last string of casing just above the lower end of the casing. The operator may later install a tieback string of casing that extends from the wellhead downward into engagement with the liner hanger assembly.

When installing a liner, in most cases, the operator drills the well to the desired depth, retrieves the drill string, then assembles and lowers the liner into the well. A liner top packer may also be incorporated with the liner hanger. A cement shoe with a check valve will normally be secured to the lower end of the liner as the liner is made up. When the desired length of liner is reached, the operator attaches a liner hanger to the upper end of the liner, and attaches a running tool to the liner hanger. The operator then runs the liner into the wellbore on a string of drill pipe attached to the running tool. The operator sets the liner hanger and pumps cement through the drill pipe, down the liner and back up an annulus surrounding the liner. The cement shoe prevents backflow of cement back into the liner. The running tool may dispense a wiper plug following the cement to wipe cement from the interior of the liner at the conclusion of the cement pumping. The operator then sets the liner top packer, if used, releases the running tool from the liner, and retrieves the drill pipe.

A variety of designs exist for liner hangers. Some may be set in response to mechanical movement or manipulation of the drill pipe, including rotation. Others may be set by dropping a ball or dart into the drill string, then applying fluid pressure to the interior of the string after the ball or dart lands on a seat in the running tool. The running tool may be attached to the liner hanger or body of the running tool by threads, shear elements, or by a hydraulically actuated arrangement.

In another method of installing a liner, the operator runs the liner while simultaneously drilling the wellbore. This method is similar to a related technology known as casing drilling. One technique employs a drill bit on the lower end of the liner. One option is to not retrieve the drill bit, rather cement it in place with the liner. If the well is to be drilled deeper, the drill bit would have to be a drillable type. This technique does not allow one to employ components that must be retrieved, which might include downhole steering tools, measuring while drilling instruments and retrievable drill bits. Retrievable bottom hole assemblies are known for casing drilling, but in casing drilling the upper end of the casing is at the rig floor. In typical liner drilling, the upper end of the liner is deep within the well and the liner is suspended on a string of drill pipe. In casing drilling, the bottom hole assembly can be retrieved and rerun by wire line, drill pipe, or by pumping the bottom hole assembly down and back up. With liner drilling, the drill pipe that suspends the liner is much smaller in diameter than the liner and has no room for a bottom hole assembly to be retrieved through it. Being unable to retrieve the bit for replacement thus limits the length that can be drilled and thus the length of the liner. If unable to retrieve and rerun the bottom hole assembly, the operator would not be able to liner drill with expensive directional steering tools, logging instruments and the like, without planning for removing the entire liner string to retrieve the tools.

If the operator wishes to retrieve the bottom hole assembly before cementing the liner, there are no established methods and equipment for doing so. Also, if the operator wishes to rerun the bottom hole assembly and continue drilling with the liner, there are no established methods and equipment for doing so.

One difficulty to overcome in order to retrieve and rerun a bottom hole assembly during liner drilling concerns how to keep the liner from buckling if it is disconnected from the drill pipe and left in the well. If the liner is set on the bottom of the well, at least part of the drilling bottom hole assembly could be retrieved to replace a bit or directional tools. But, there is a risk that the liner might buckle due to inadequate strength to support its weight in compression. A liner hanger, if set in a pre-existing casing string, would support the weight of the string of liner. However, current technology sets the liner hanger only once, at the conclusion of the drilling and after cementing.

Some liner drilling proposals involve connecting a bottom hole assembly to a string of drill pipe and running the drill pipe to the bottom of the liner. Retrieving the drill string at the conclusion of the drilling would retrieve the bottom hole assembly. However, those proposals require an anchoring device to the lower portion of the liner or heavyweight pipe in the lower part of the drill pipe string to keep the drill pipe string from buckling.

SUMMARY OF THE INVENTION

In one aspect of the invention, concentric inner and outer strings of tubulars are assembled with a drilling bottom hole assembly located at the lower end of the inner string. The outer string includes a string of liner with a liner hanger at its upper end. The operator lowers the inner and outer strings into the well and rotates the drill bit and an underreamer or a drill shoe on the liner to drill the well. At a selected total liner depth, the liner hanger is set and the inner string is retrieved for cementing. The operator then lowers a packer and a cement retainer on a string of conduit into the well, positions the cement retainer inside the outer string, and engages the packer with the liner hanger. The operator pumps cement down the string of liner and up an outer annulus surrounding the liner. The operator also conveys the cement retainer to a lower portion of the string of liner either before or after pumping the cement. The cement retainer prevents the cement in the outer annulus from flowing back up the string of conduit. The operator then manipulates the conduit to set the packer.

In another aspect of the invention, prior to reaching the selected total depth for the liner, the operator sets the liner hanger, releases the liner hanger running tool, and retrieves the inner string. The liner hanger engages previously installed casing to support the liner in tension. The operator repairs or replaces components of the inner string and reruns them back into the outer string. The operator then re-engages the running tool and releases the liner hanger and continues to rotate the drill bit and underreamer or drill shoe to deepen the well.

Preferably the setting and resetting of the liner hanger is performed by a liner hanger running or control tool mounted to the inner string. In one embodiment, the operator drops a sealing element onto a seat located in the liner hanger control tool. The operator then pumps fluid down the inner string to move a portion of the liner hanger control tool axially relative to the inner string. This movement along with slacking off weight on the inner string results in the liner hanger moving to an engaged position with the casing. The liner hanger is released by re-engaging the liner control tool with the liner hanger, lifting the liner string and applying fluid pressure to stroke the slips of the liner hanger downward to a retracted position.

In still another aspect of the invention, seals are located between the inner string and the outer string near the top and bottom of the liner, defining an inner annular chamber. The operator communicates a portion of the drilling fluid flowing down the inner string to this annular chamber to pressurize the inner chamber. The pressure stretches the inner string to prevent it from buckling. Preferably, the pressure in the annular chamber is maintained even while adding additional sections of tubulars to the inner string. This pressure maintenance may be handled by a check valve located in the inner string.

DETAILED DESCRIPTION OF THE INVENTION

Figure 1:
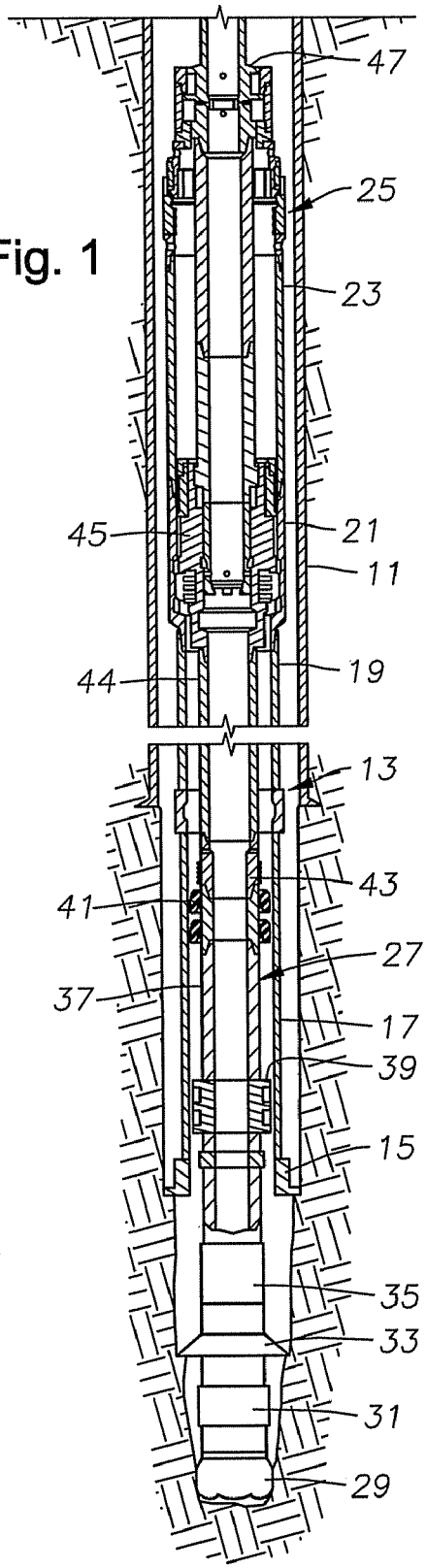
FIG. 1 is a schematic sectional view of inner and outer concentric strings during drilling.

Referring to FIG. 1, a well is shown having a casing 11 that is cemented in place. An outer string 13 is located within casing 11 and extends below to an open hole portion of the well. In this example, outer string 13 is made up of a drill shoe 15 on its lower end that may have cutting elements for reaming out the well bore. A tubular shoe joint 17 extends upward from drill shoe 15 and forms the lower end of a string of liner 19. Liner 19 comprises pipe that is typically the same type of pipe as casing, but normally is intended to be cemented with its upper end just above the lower end of casing 11, rather than extending all the way to the top of the well or landed in a wellhead and cemented. The terms "liner" and "casing" may be used interchangeably. Liner 19 may be several thousand feet in length.

Outer string 13 also includes a latch collar, profile nipple or sub 21 mounted to the upper end of liner 19. Profile nipple 21 is a tubular member having grooves and recesses formed in it for use during drilling operations, as will be explained subsequently. A tieback receptacle 23, which is another tubular member, extends upward from profile nipple 21. Tieback receptacle 23 is a section of pipe having a smooth bore for receiving a tieback sealing element used to land seals from a liner top packer assembly or seals from a tieback seal assembly. Outer string 13 also includes in this example a liner hanger 25 that is resettable from a disengaged position to an engaged position with casing 11. For clarity, casing 11 is illustrated as being considerably larger in inner diameter than the outer diameter of outer string 13, but the annular clearance between liner hanger 25 and casing 11 may smaller in practice.

An inner string 27 is concentrically located within outer string 13 during drilling. Inner string 27 includes a pilot bit 29 on its lower end. Auxiliary equipment 31 may optionally be incorporated with inner string 27 above pilot bit 29. Auxiliary equipment 31 may include directional control and steering equipment for inclined or horizontal drilling. It may include logging instruments as well to measure the earth formations. In addition, inner string 27 normally includes an underreamer 33 that enlarges the well bore being initially drilled by pilot bit 29. Optionally, inner string 27 may include a mud motor 35 that rotates pilot bit 29 relative to inner string 27 in response to drilling fluid being pumped down inner string 27.

A string of drill pipe 37 is attached to mud motor 35 and forms a part of inner string 27. Drill pipe 37 may be conventional pipe used for drilling wells or it may be other tubular members. During drilling, a portion of drill pipe 37 will extend below drill shoe 15 so as to place drill bit 29, auxiliary equipment 31 and reamer 33 below drill shoe 15. An internal stabilizer 39 may be located between drill pipe 37 and the inner diameter of shoe joint 17 to stabilize and maintain inner string 27 concentric.

Optionally, a packoff 41 may be mounted in the string of drill pipe 37. Packoff 41 comprises a sealing element, such as a cup seal, that sealingly engages the inner diameter of shoe joint 17, which forms the lower end of liner 19. If utilized, pack off 41 forms the lower end of an annular chamber 44 between drill pipe 37 and liner 19. Optionally, a drilling latch or drill lock tool 45 at the upper end of liner 19 forms a seal with part of outer string 13 to seal an upper end of inner annulus 44. In this example, a check valve 43 is located between pack off 41 and drill lock tool 45. Check valve 43 admits drilling fluid being pumped down drill pipe 37 to inner annulus 44 to pressurize inner annulus 44 to the same pressure as the drilling fluid flowing through drill pipe 37. This pressure pushes downward on packoff 41, thereby tensioning drill pipe 37 during drilling. Applying tension to drill pipe 37 throughout much of the length of liner 19 during drilling allows one to utilize lighter weight pipe in the lower portion of the string of drill pipe 37 without fear of buckling. Preferably, check valve 43 prevents the fluid pressure in annular chamber 44 from escaping back into the inner passage in drill pipe 37 when pumping ceases, such as when an adding another joint of drill pipe 37.

Drill pipe 37 connects to drill lock tool 45 and extends upward to a rotary drive and weight supporting mechanism on the drilling rig. Often the rotary drive and weight supporting mechanism will be the top drive of a drilling rig. The distance from drill lock tool 45 to the top drive could be thousands of feet during drilling. Drill lock tool 45 engages profile nipple 21 both axially and rotationally. Drill lock tool 45 thus transfers the weight of outer string 13 to the string of drill pipe 37. Also, drill lock tool 45 transfers torque imposed on the upper end of drill pipe 37 to outer string 13, causing it to rotate in unison.

A liner hanger control tool 47 is mounted above drill lock tool 45 and separated by portions of drill pipe 37. Liner hanger control tool 47 is employed to release and set liner hanger 25 and also to release drill lock tool 45. Drill lock tool 45 is located within profile nipple 21 while liner hanger control tool 47 is located above liner hanger 25 in this example.

In brief explanation of the operation of the equipment shown in FIG. 1, normally during drilling the operator rotates drill pipe 37 at least part of the time, although on some occasions only mud motor 35 is operated, if a mud motor is utilized. Rotating drill pipe 37 from the drilling rig, such as the top drive, causes inner string 27 to rotate, including drill bit 29. Some of the torque applied to drill pipe 37 is transferred from drill lock tool 45 to profile nipple 21. This transfer of torque causes outer string 13 to rotate in unison with inner string 27. In this embodiment, the transfer of torque from inner string 27 to outer string 13 occurs only by means of the engagement of drill lock tool 45 with profile nipple 21. The operator pumps drilling fluid down inner string 27 and out nozzles in pilot bit 29. The drilling fluid flows back up an annulus surrounding outer string 13.

If, prior to reaching the desired total depth for liner 19, the operator wishes to retrieve inner string 27, he may do so. In this example, the operator actuates liner hanger control tool 47 to move the slips of liner hanger 25 from a retracted position to an engaged position in engagement with casing 11. The operator then slacks off the weight on inner string 27, which causes liner hanger 25 to support the weight of outer string 13. Using liner hanger control tool 47, the operator also releases the axial lock of drill lock tool 45 with profile nipple 21. This allows the operator to pull inner string 27 while leaving outer string 13 in the well. The operator may then repair or replace components of the bottom hole assembly including drill bit 29, auxiliary equipment 31, underreamer 33 and mud motor 35. The operator also resets liner hanger control tool 47 and drill lock tool 45 for a reentry engagement, then reruns inner string 27. The operator actuates drill lock tool 45 to reengage profile nipple 21 and lifts inner string 27, which causes drill lock tool 45 to support the weight of outer string 13 and release liner hanger 25. The operator reengages liner hanger control tool 47 with liner hanger 25 to assure that its slips remain retracted. The operator then continues drilling. When at total depth, the operator repeats the process to remove inner string 27, then may proceed to cement outer string 13 into the well bore.

Figure 2:
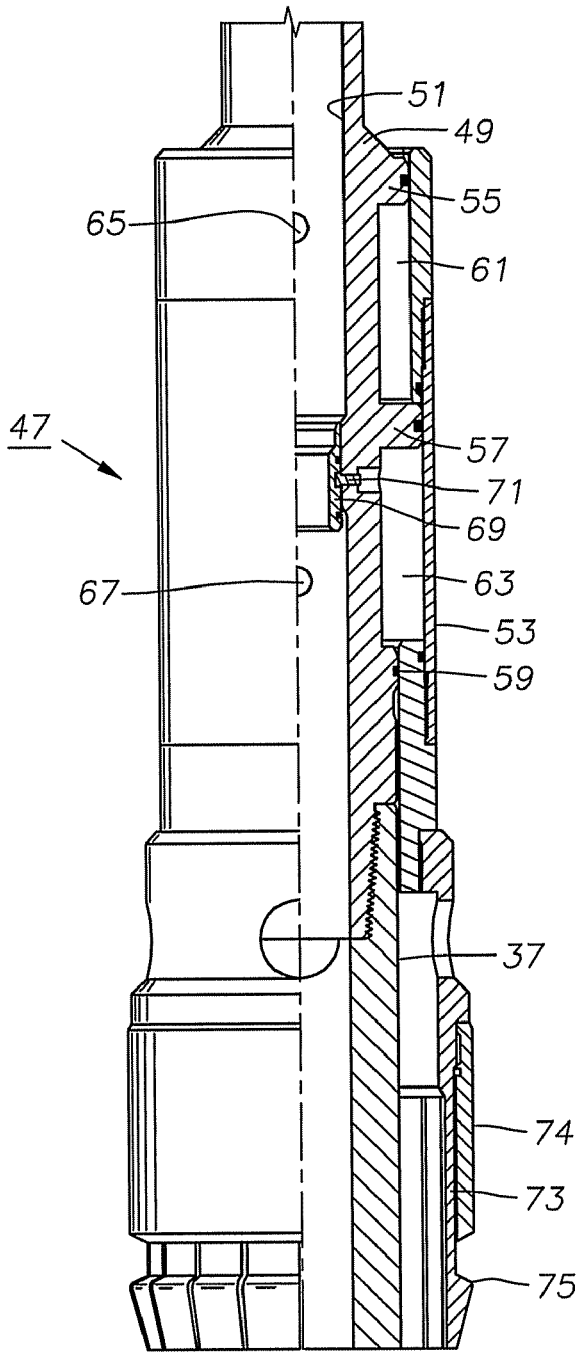
FIG. 2 is an enlarged sectional view of a liner hanger control tool of the system of FIG. 1 and shown in a position employed during drilling.

FIG. 2 illustrates one example of liner hanger control tool 47. In this embodiment, liner hanger control tool 47 has a tubular mandrel 49 with an axial flow passage 51 extending through it. The lower end of mandrel 49 connects to a length of drill pipe 37 that extends down to drill lock tool 45. The upper end of mandrel 49 connects to additional strings of drill pipe 37 that lead to the drilling rig. An outer sleeve 53 surrounds mandrel 49 and is axially movable relative to mandrel 49. In this embodiment, an annular upper piston 55 extends around the exterior of mandrel 49 outward into sealing and sliding engagement with outer sleeve 53. An annular central piston 57, located below upper piston 55, extends outward from mandrel 49 into sliding engagement with another portion of outer sleeve. 53. Outer sleeve 53 is formed of multiple components in this example, and the portion engaged by central piston 57 has a greater inner diameter than the portion engaged by upper piston 55. An annular lower piston 59 is formed on the exterior of mandrel 49 below central piston 57. Lower piston 59 sealingly engages a lower inner diameter portion of outer sleeve 53. The portion engaged by lower piston 59 has an inner diameter that is less than the inner diameter of the portion of outer sleeve 53 engaged by upper piston 55.

Pistons 55, 57, 59 and outer sleeve 53 define an upper annular chamber 61 and a lower annular chamber 63. An upper port 65 extends between mandrel axial flow passage 51 and upper annular chamber 61. A lower port 67 extends from mandrel axial flow passage 51 to lower annular chamber 63. A seat 69 is located in axial flow passage 51 between upper and lower ports 65, 67. Seat 69 faces upward and preferably is a ring retained by a shear pin 71.

A collet 73 is attached to the lower end of outer sleeve 53. Collet 73 has downward depending fingers 75. An external sleeve 74 surrounds an upper portion of fingers 75. Fingers 75 have upward and outward facing shoulders and are resilient so as to deflect radially inward. Fingers 75 are adapted to engage liner hanger 25, shown in FIG. 3. Liner hanger 25 includes a sleeve 76 containing a plurality of gripping members or slips 77 carried within windows 79. When pulled upward, slips 77 are cammed out by ramp surfaces so that they protrude from the exterior of sleeve 76 and engage casing 11 (FIG. 1). Slips 77 are shown in the retracted position in FIG. 3. While slips 77 are extended, applying weight to sleeve 76 causes slips 77 to grip casing 11 more tightly. Fingers 75 (FIG. 2) of collet 73 snap into a recess in slips 77 (FIG. 3) to lift them when outer sleeve 53 moves up relative to liner hanger 25. When outer sleeve 53 moves downward relative to liner hanger 25, the sleeve 74 contacts slips 77 to prevent them from moving up.

Figure 3:
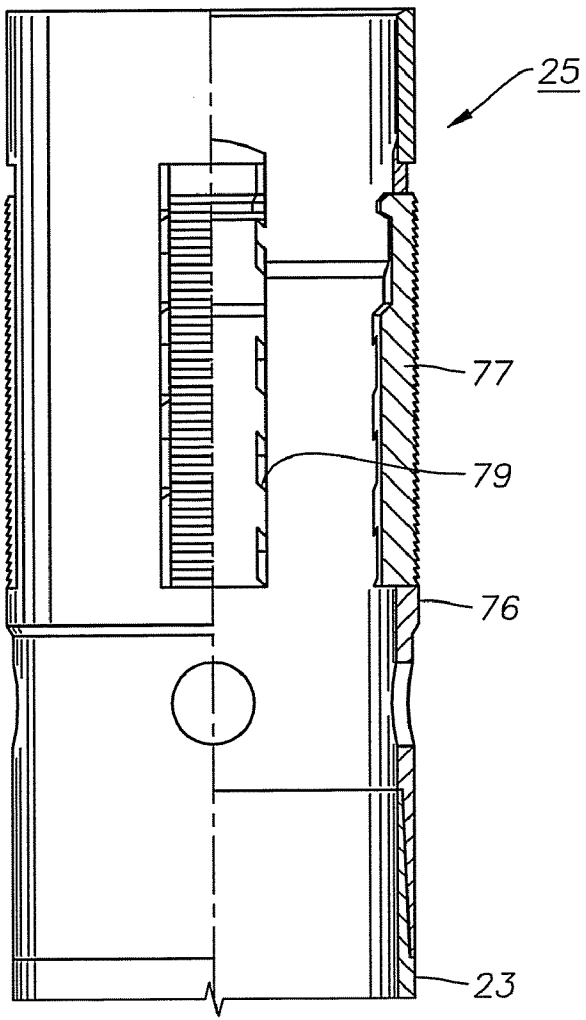
FIG. 3 is an enlarged sectional view of the liner hanger employed in the system of FIG. 1 and shown in a retracted position.

In explanation of the components shown in FIGS. 2 and 3, liner hanger control tool 47 is shown in a released position. Applying drilling fluid pressure to passage 51 causes pressurized drilling fluid to enter both ports 65 and 66 and flow into chambers 61 and 63. The same pressure acts on pistons 55, 57 and 57, 59, resulting in a net downward force that causes outer sleeve 53 and fingers 75 to move downward to the lower position shown in FIG. 2. In the lower position, the shoulder at the lower end of chamber 61 approaches piston 57 while sleeve 74 transfers the downward force to slips 77 (FIG. 3), maintaining slips 77 in their lower retracted position.

As will be explained in more detail subsequently, to retrieve inner string 27 (FIG. 1), the operator drops a sealing element 70 (FIG. 7), such as a ball or dart, onto seat 69. The drilling fluid pressure is now applied only through upper port 65 to upper chamber 61 and not lower port 67. The differential pressure areas of pistons 55 and 57 cause outer sleeve 53 to move upward relative to mandrel 49, bringing with it fingers 75 and slips 77 (FIG. 3). Then, slacking weight off inner string 27 will cause slips 77 to grip casing 11 (FIG. 1). Liner hanger control tool 47 thus has porting within it that in one mode causes outer sleeve 53 to move downward to retract liner hanger slips 77 and in another mode to move upward to set slips 77. Arrangements other than the three differential area pistons 55, 57 and 59 may be employed to move outer sleeve 53 upward and downward.

Figure 4:
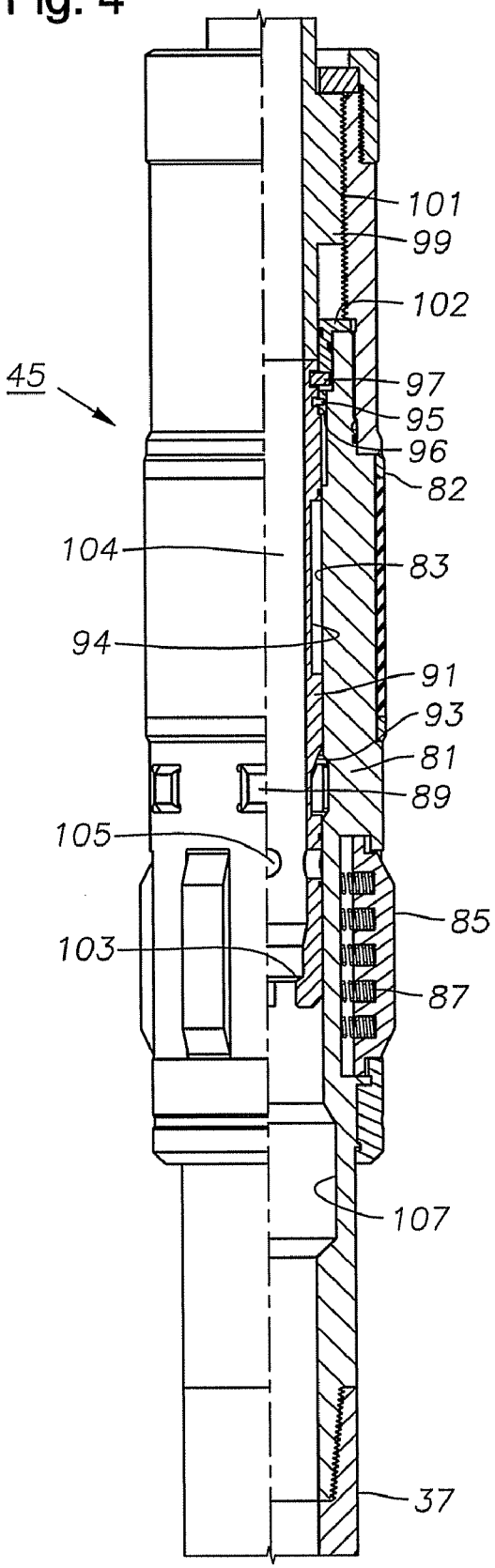
FIG. 4 is an enlarged sectional view of a drill lock tool employed with the system of FIG. 1, with its cone mandrel shown in a run-in position.

One example of drill lock tool 45 is illustrated in FIG. 4. Drill lock tool 45 has a multi-piece housing 81 containing a bore 83. Annular seals 82 on the exterior of housing 81 are adapted to sealingly engage profile nipple 21 (FIG. 6) to form the sealed upper end of annular chamber 44 (FIG. 4). Torque keys 85 are mounted to and spaced around the exterior of housing 81. Torque keys 85 are biased outward by springs 87 for engaging axial slots (not shown) located within profile nipple 21 (FIG. 1). When engaged, rotation of housing 81 transmits torque to profile nipple 21 (FIG. 1). Drill lock tool 45 also has an axial lock member, which in this embodiment comprises a plurality of dogs or axial locks 89, each located within a window formed in housing 81. Each axial lock 89 has an inner side exposed to bore 83 and an outer side capable of protruding from housing 81. When in the extended position, axial locks 89 engage an annular groove 90 (FIG. 6) in profile nipple 21. This engagement axially locks drill lock tool 45 to profile nipple 21 and enables inner string 27 (FIG. 1) to support the weight of outer string 13.

Figure 6:
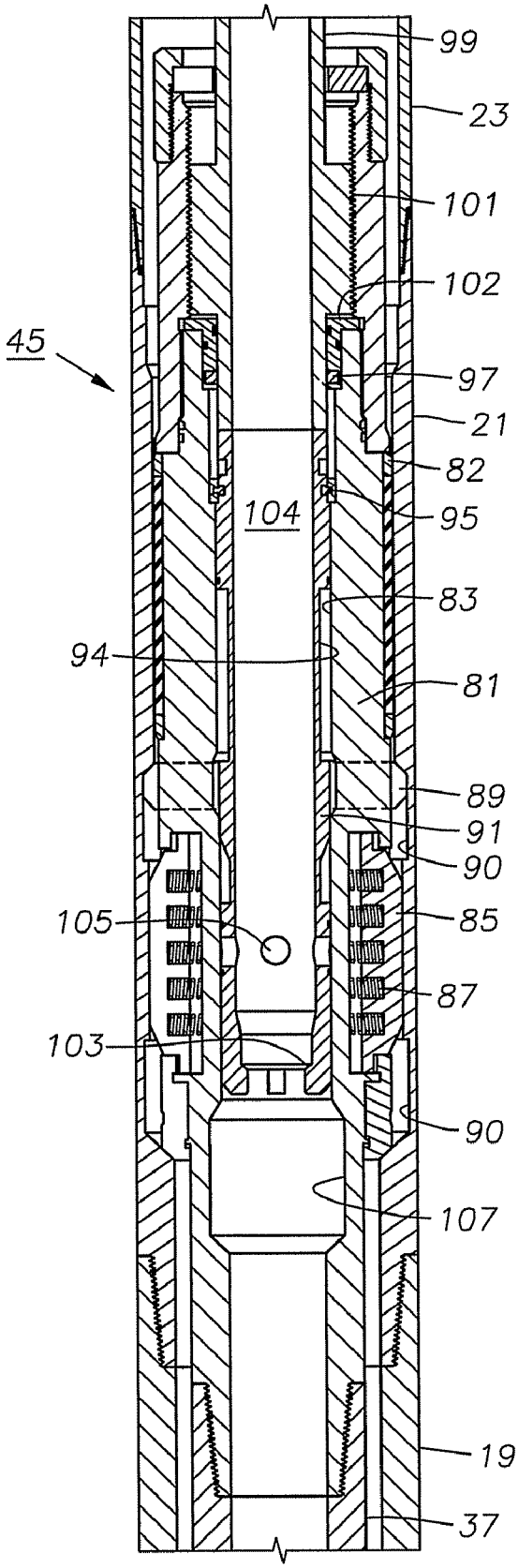
FIG. 6 is a sectional view of the drill lock tool of FIG. 4 with its cone mandrel shown in a set position.
Figure 9:
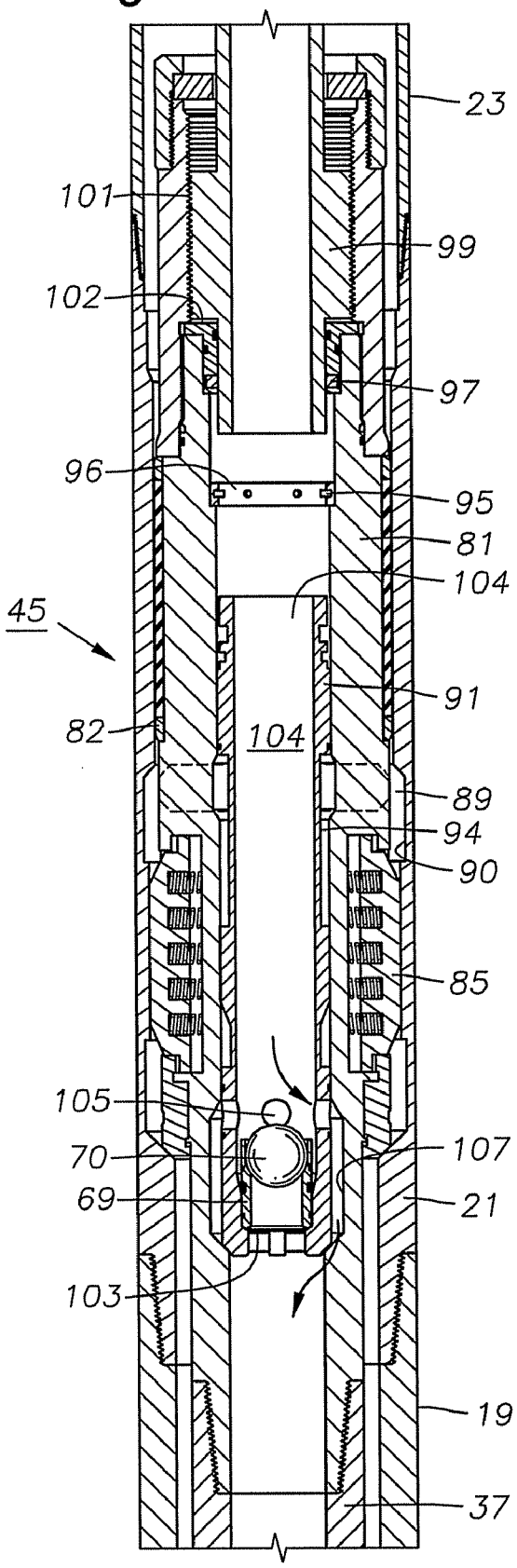
FIG. 9 is a sectional view of the drill lock tool of FIG. 4, with its cone mandrel in the released position.

Axial locks 89 are moved from the retracted to the extended position and retained in the extended position by a cone mandrel 91 that is carried within housing 81. Cone mandrel 91 has a ramp 93 that faces downwardly and outwardly. When cone mandrel 91 is moved downward in housing 81, ramp 93 pushes axial locks 89 from their retracted to the extended position. Cone mandrel 91 has three positions in this example. A run-in position is shown in FIG. 1, wherein ramp 93 is spaced above axial locks 89. Downward movement of cone mandrel 91 from the run-in position moves it to the set position, which is shown in FIG. 6. In the set position, axial locks 89 are maintained in the extended position by the back-up engagement of a cylindrical portion of cone mandrel 91 just above ramp 93. Downward movement from the set position in housing 81 places cone mandrel 91 in the released position, which is illustrated in FIG. 9. In the released position, annular recess 94 (FIG. 4) on the exterior of cone mandrel 91 aligns with the inner ends of axial locks 89. This allows axial locks 89 to move inward to the retracted position when drill lock tool 45 is lifted.

Referring again to FIG. 4, shear screws 95 are connected between cone mandrel 91 and a ring 96. Ring 96 is free to slide downward with cone mandrel 91 as it moves from the run-in position (FIG. 4) to the set position (FIG. 6). In the set position, ring 96 lands on an upward-facing shoulder formed in bore 83 of housing 81, retaining cone mandrel 91 in the set position. Shear screws 95 shear when cone mandrel 91 is moved from the set position to the released position (FIG. 9).

Reentry shear screws 97 are shown connected between cone mandrel 91 and a shoulder member 102, which is a part of housing 81. As will be explained subsequently, preferably reentry shear screws 97 are not installed during the initial run-in of the liner drilling system of FIG. 1. Rather, they are installed only for use during re-entry of drill lock tool 45 back into engagement with profile nipple 21. The reason will be explained subsequently.

In this example, cone mandrel 91 is moved from its run-in position to its set position by a downward force applied from a threaded stem 99 extending axially upward from cone mandrel 91. Stem 99 has external threads 101 that engage mating threads formed within bore 83. Rotating threaded stem 99 will cause it to move downward from the upper position shown in FIG. 4 to the lower position in FIG. 6, exerting a downward force on cone mandrel 91. Cone mandrel 91 is a separate component from threaded stem 99 in this embodiment, and does not rotate with it. Threads 101 may be of a multi-start high pitch type. Threaded stem 99 is connected to drill pipe 37 (FIG. 1) that extends upward to liner hanger control tool 47. While threaded stem 99 is in the lower position, it will be in contact with shoulder member 102 located in bore 83 of housing 81.

A seat 103 is formed within an axial flow passage 104 in cone mandrel 91. Seat 103 faces upward and in this embodiment it is shown on the lower end of axial passage 104. A port 105 extends from passage 104 to the exterior of cone mandrel 91. An annular cavity 107 is located in bore 83 below the lower end of cone mandrel 91 while cone mandrel 91 is in its run-in (FIG. 4) and set (FIG. 6) positions. When cone mandrel 91 is in the lowest or released position, which is the position shown in FIG. 9, ports 105 will be aligned with cavity 107. This alignment enables fluid being pumped down passage 104 to flow around sealing element 70 when it is located on seat 103 as shown in FIG. 9.

Figure 5:
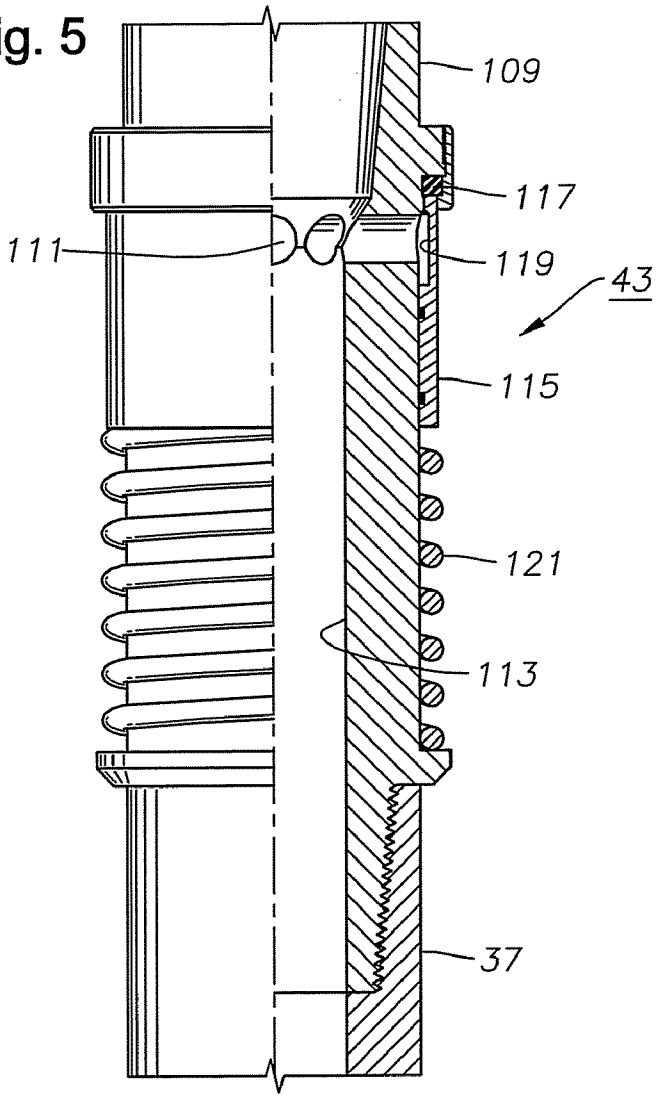
FIG. 5 is a sectional view of a check valve employed with the inner string of the system of FIG. 1 and shown in a closed position.

Referring to FIG. 5, an example of check valve 43 is illustrated. Check valve 43 has a body 109 that is tubular and has upper and lower threaded ends for a connection into drill pipe 37. One or more ports 111 extends from axial passage 113 to the exterior of body 109. A sleeve 115 is carried moveably on the exterior of body 109. Sleeve 115 has interior seals that seal to the exterior of body 109. Sleeve 115 also has an upper end that engages a seal 117. Sleeve 115 has an annular cavity 119 that aligns with ports 111 when sleeve 115 is in the closed or upper position. The pressure area formed by annular cavity 119 results in a downward force on sleeve 115 when drilling fluid pressure is supplied to passage 113. Normal drilling fluid pressure creates a downward force that pushes sleeve 115 downward, compressing a coil spring 121 and allowing flow out ports 117. When the drilling fluid pumping ceases, the pressure within passage 113 will be the same as on the exterior of body 109. Spring 121 will then close ports 111. As shown in FIG. 1, the closure of ports 111 will seal the higher drilling fluid pumping pressure within inner annulus 44, maintaining the portion of drill string 37 between seals 82 (FIG. 6) of drill lock tool 45 and pack off 41 in tension.

In the operation of the embodiment shown in FIGS. 1-5, the operator would normally first assemble and run liner string 19 and suspend it at the rig floor of the drilling rig. The operator would make up the bottom hole assembly comprising drill bit 29, auxiliary equipment 31 (optional), reamer 33 and mud motor 35 (optional), check valve 43, and packoff 41 and run it on drill pipe 37 into outer string 13. When a lower portion of the bottom hole assembly has protruded out the lower end of outer string 13 sufficiently, the operator supports the upper end of drill pipe 37 at a false rotary on the rig floor. Thus, the upper end of liner string 19 will be located at the rig floor as well as the upper end of drill pipe 37. Preferably, the operator preassembles an upper assembly to attach to liner string 19 and drill pipe 37. The preassembled components include profile nipple 21, tieback receptacle 23 and liner hanger 25. Drill lock tool 45 and liner hanger control tool 47 as well as intermediate section of drill pipe 37 would be located inside. Drill lock tool 45 would be axially and rotationally locked to profile nipple 21. The operator picks up this upper assembly and lowers it down over the upper end of liner 19 and the upper end of drill pipe 37. The operator connects the upper end of drill pipe 37 to the lower end of housing 81 (FIG. 4) of drill lock tool 45. The operator connects the lower end of profile nipple 21 to the upper end of liner 19.

The operator then lowers the entire assembly in the well by adding additional joints of drill pipe 37. The weight of outer string 13 is supported by the axial engagement between profile nipple 21 and drill lock tool 45. When on or near bottom, the operator pumps drilling fluid through drill pipe 37 and out drill bit 29, which causes drill bit 29 to rotate if mud motor 35 (FIG. 1) is employed. The operator may also rotate drill pipe 37. As shown in FIG. 2, the drilling fluid pump pressure will exist in both upper and lower chamber 61, 63, which results in a net downward force on sleeve 74. Sleeve 74 will be in engagement with the upper ends of slips 77 (FIG. 3) of liner hanger 25, maintaining slips 77 in the retracted position.

Figure 7:
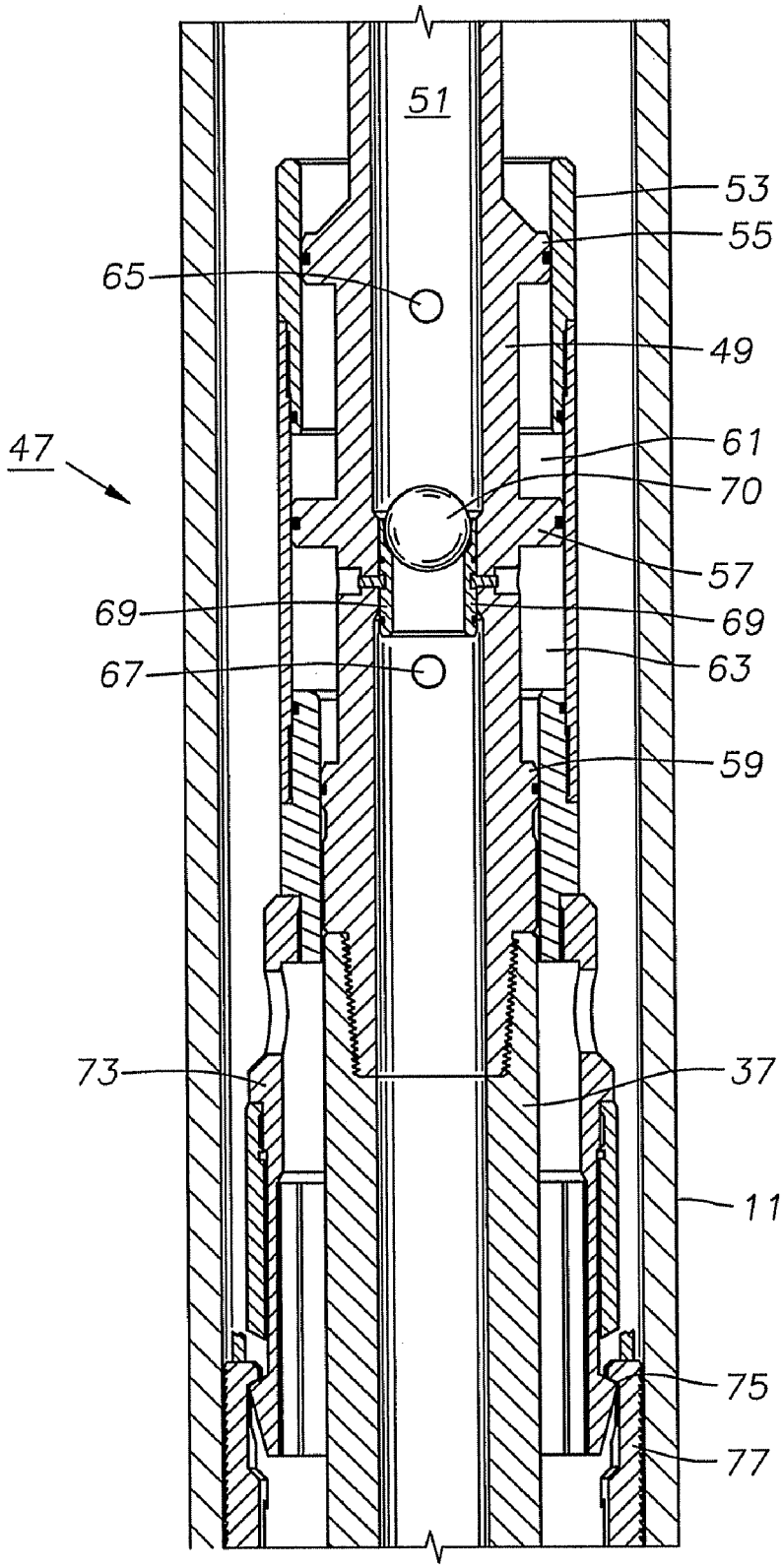
FIG. 7 is a sectional view of the liner hanger control tool of FIG. 2, with the liner hanger control tool in the process of moving from the set position to a released position.

While drilling, if it is desired to repair or replace portions of the bottom hole assembly, the operator drops sealing element 70 down drill pipe 37. As illustrated in FIG. 7, sealing element 70 lands on seat 69 in liner hanger control tool 47. The drilling fluid pressure now communicates only with upper chamber 61 because of sealing element 70 is blocking the entrance to lower port 67. This results in upward movement of outer sleeve 53 and fingers 75 relative to mandrel 49, causing liner hanger slips 77 to move to the set or extended position in contact with casing 11 (FIG. 1). The operator slacks off weight on drill pipe 37, which causes slips 77 to grip casing 11 and support the weight of outer string 13.

Figure 8:
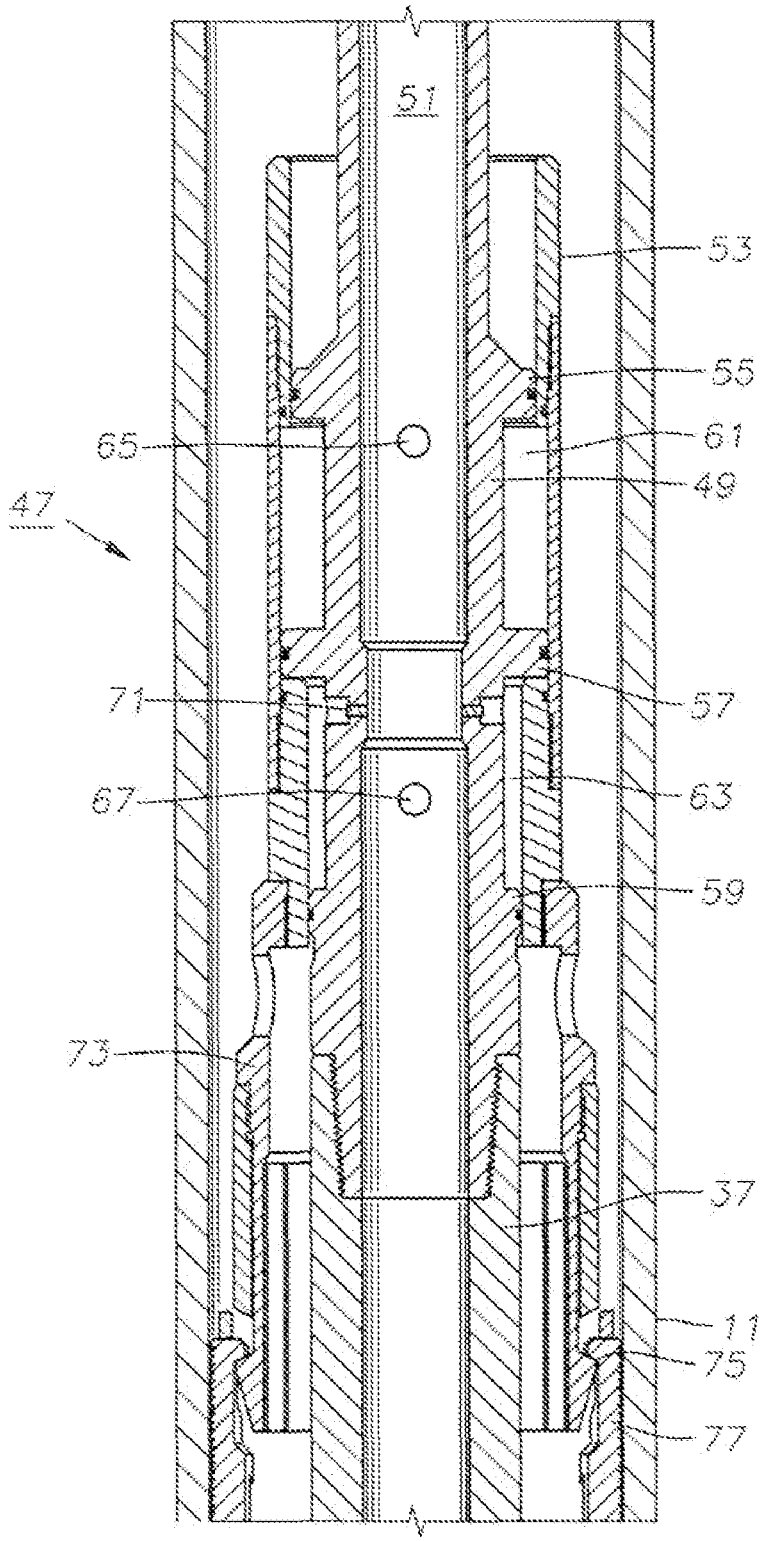
FIG. 8 is a sectional view of the liner hanger control tool of FIG. 2, shown in the released position and with its ball seat sheared.

The operator then increases the pressure of the drilling fluid in drill pipe 37 above sealing element 70 to a second level. This increased pressure shears seat 69, causing sealing element 70 and seat 69 to move downward out of liner hanger control tool 47 as shown in FIG. 8. Sealing element 70 drops down into engagement with seat 103 in cone mandrel 91 as shown in FIG. 9. The drilling fluid pressure acts on sealing element 70, shears shear screws 95, and pushes cone mandrel 91 from the set position to the released position shown in FIG. 9. When in the released position, the drilling fluid flow will be bypassed around sealing element 70 and flow downward and out pilot bit 29 (FIG. 1). This drop in flow pressure may provide an indication to the operator that axial locks 89 have retracted. The operator then pulls inner string 27 from the well, leaving outer string 13 suspended by liner hanger 25. If no reentry is desired, the operator would then proceed to cementing.

Figure 11:
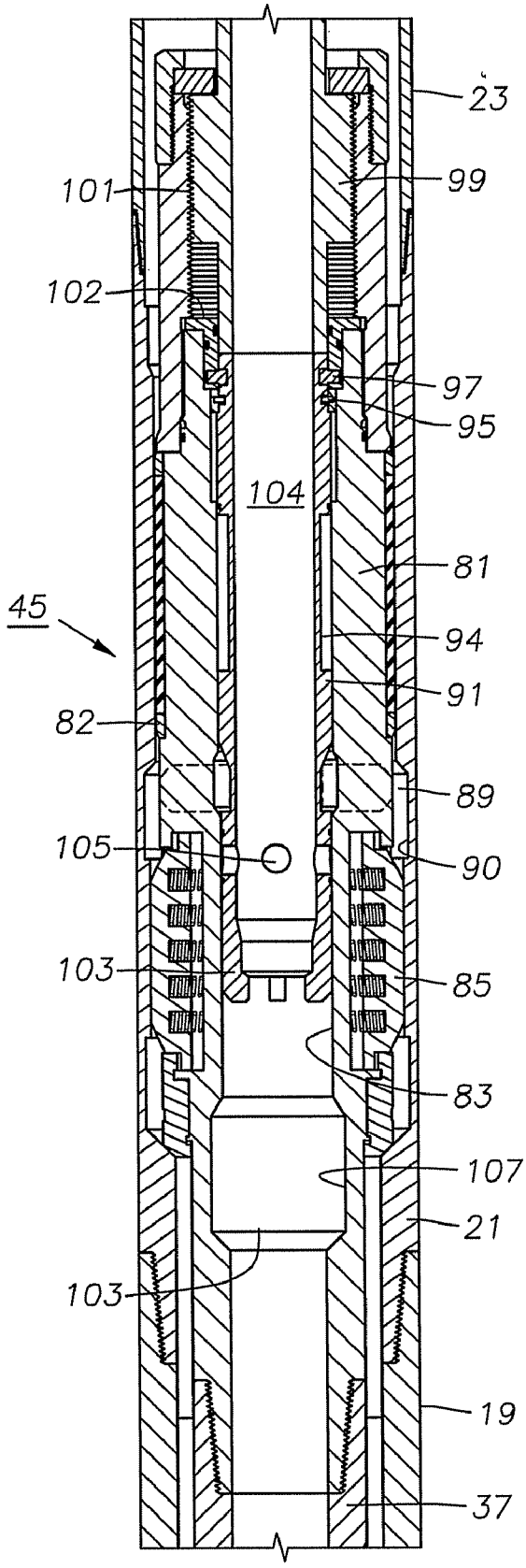
FIG. 11 is a sectional view of the drill lock tool of FIG. 4 in position for re-entering the profile nipple of the system of FIG. 1.
Figure 10:
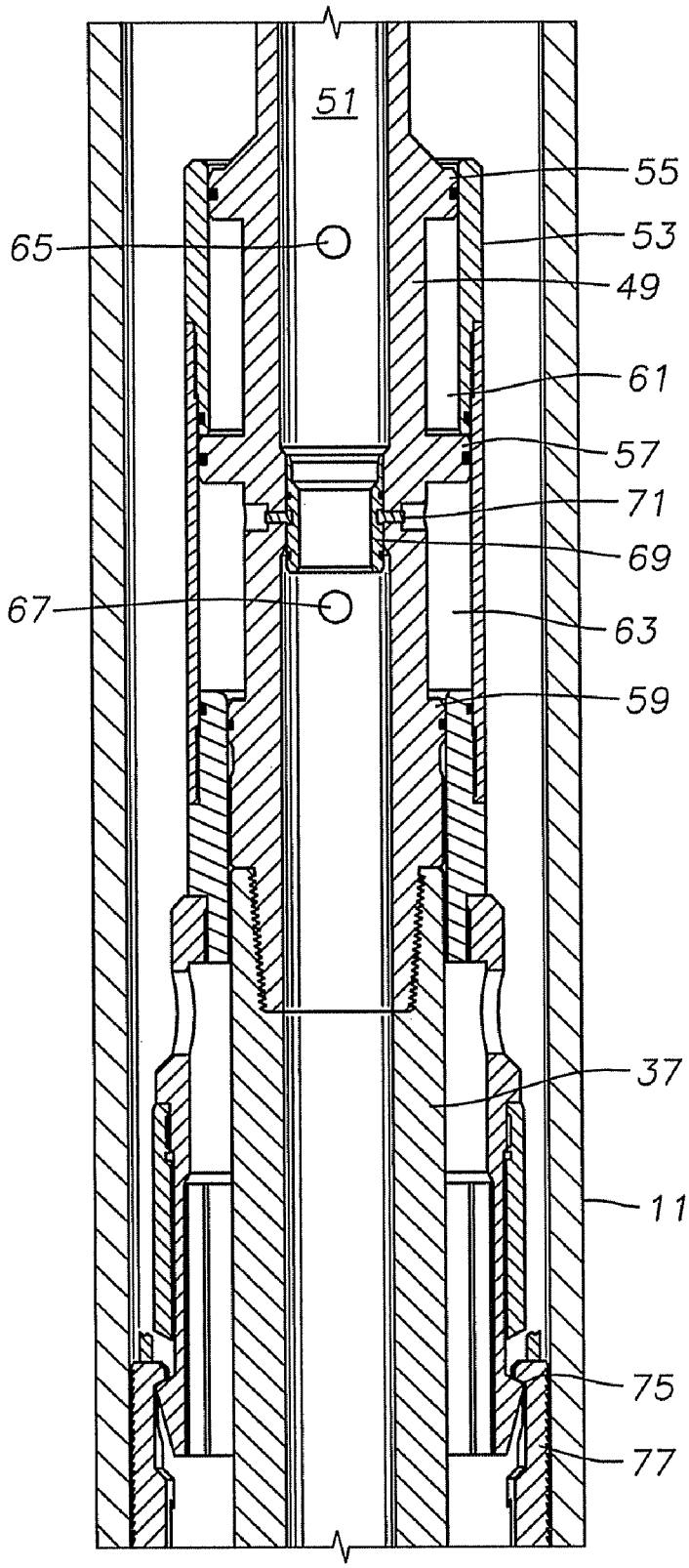
FIG. 10 is a sectional view of the liner hanger control tool of FIG. 2 shown re-entering the well bore to reconnect with the liner hanger of the system of FIG. 1.

If reentry is desired, the operator then attaches the new components, such as a new drill bit 29. The operator also reinstalls seat 69 as shown in FIG. 10. The operator places threaded stem 99 of drill lock tool 45 in the upper position shown in FIG. 11. The operator places cone mandrel 91 in the upper or run-in position and installs reentry shear screws 97 and set shear screw 95. The operator re-runs inner string 27. A lower portion of housing 81 will eventually land on a shoulder in profile nipple 21 as shown in FIG. 11. If before reaching the shoulder in profile nipple 21, the operator needs to perform some drilling with drill bit 29 by rotating inner string 27, he may do so before engaging drill lock tool 45 with profile nipple 21. As the operator starts to rotate the upper portion of drill pipe 37, a component of the force would tend to rotate threaded stem 99 relative to the housing 81, exerting a downward force on cone mandrel 91. However, the high pitch, multi-start thread preferably utilized for threads 101 will not transmit a large enough downward force to shear reentry shear screws 97 in response to the application of torque to threaded stem 99. Rather, torque is transferred through threads 101 to housing 81, the lower end of which is connected to the lower portion of inner string 27. Consequently, the rotation of the entire inner string 27 would occur without any rotation of outer string 13.

Once drill lock tool 45 has landed on the upward facing shoulder in profile nipple 21 as shown in FIG. 11, the operator will actuate drill lock tool 45 to latch it to profile nipple 21. He does this by slacking off considerable weight on inner string 27 while holding torque on inner string 27. The increased downward force on threaded stem 99 transfers through reentry shear screws 97 to outer housing 81 of drill lock tool 45, causing reentry shear screws 97 to shear. Then, rotating the upper portion of inner string 37 will cause threaded stem 99 to move downward, pushing cone mandrel 91 from the upper run-in position downward to the set position shown in FIG. 6. Once axial locks 89 are locked with the profile nipple 21, the operator can pick up inner string 37, which lifts outer string 13 with it, causing liner hanger slips 77 (FIG. 3) to move down to the retracted position.

The operator may start pumping drilling fluid through inner string 27. The drilling fluid will exert pressure within chambers 61 and 63, thereby causing collet sleeve 74 to move downward to the lower position shown in FIG. 10. In the lower position, collet sleeve 74 prevents liner hanger slips 77 (FIG. 3) from inadvertently moving upward to a set position. At the desired total depth for liner 19, the operator repeats the process to set liner hanger 25 and remove inner string 27 from outer string 13.

Figure 12A:
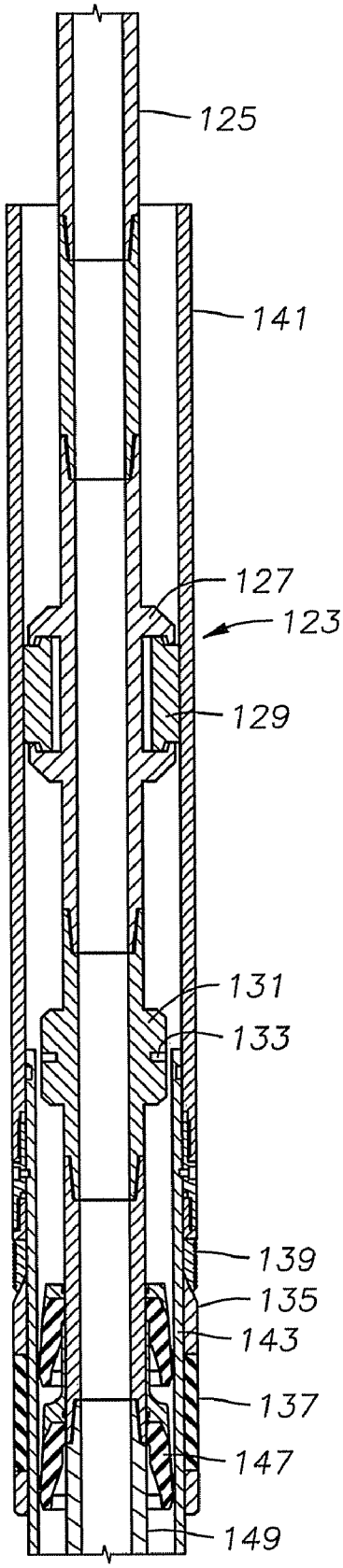
FIGS. 12A and 12B comprise a sectional view of a cementing string being lowered into engagement with the liner hanger of the system of FIG. 1.
Figure 12B:
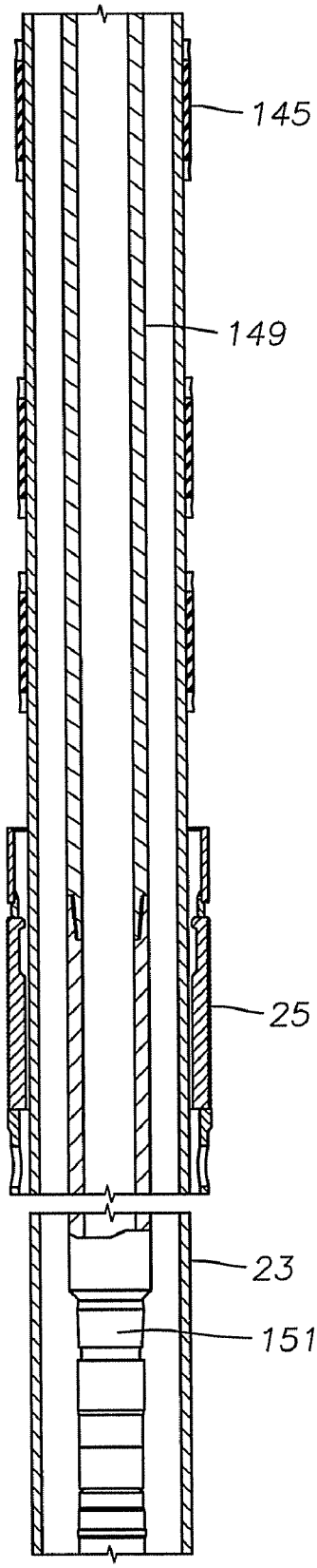

At the total depth for liner 19, outer string 13 will be in a much lower position than shown in FIG. 1. Liner hanger 25 will be located a short distance above the lower end of casing 11. Liner hanger 25 will be supporting the weight of outer string 13 and transferring that weight to casing 11. The operator then assembles a cementing string 123, an example of which is shown in FIGS. 12A and 12B. Cementing string 123 includes an inner conduit 125 that would likely comprise the same drill pipe as drill pipe 37, but it could comprise tubing or other conduits. A packer actuator 127 is supported on inner conduit 125. Packer actuator 127 has a plurality of lugs 129 that are biased radially outward. A packer running tool 131 is secured to the lower end of packer actuator 127 in this example. Packer running tool 131 is releasably connected by a release element 133 to a packer 135. Release element 133 could comprise a set of shear screws or it could be other types of latch members, including those that release in response to rotation. Packer 135 is of a type that has an elastomeric element 137 that sets in response to downward movement of slips 139. Slips 139 will grip the interior of casing 11 (FIG. 1) to hold packer 135 in a set position. Packer 135 is optional, and in some wells may not be required.

An optional tieback receptacle 141 extends upward a selected distance from packer 135 for subsequently receiving a tieback casing string (not shown). Tieback receptacle 141 comprises a cylindrical pipe having a smooth bore that is substantially the same inner diameter as liner 19 in this example. A tieback sealing element 143 extends below packer 135. Tieback sealing element 143 comprises a cylindrical member having sealing bands 145 on its exterior for sealing engagement with tieback receptacle 23 (FIG. 1). Tieback sealing element 143 has the same outer diameter as tieback receptacle 141 in this embodiment. A running tool pack off 147 comprising cup seals is connected to packer running tool 131. Running tool pack off 147 is adapted to seal against the inner diameter of liner 19 and tieback sealing element 143, which is located on the upper end of liner 19 (FIG. 1). A wiper plug extension 149, which may be the same type of conduit as conduit 125, extends below running tool pack off 147. A cement retainer 151 is located on the lower end of wiper plug extension 149.

Cement retainer 151 may be of a variety of types and is employed to prevent the backflow of cement from the outer annulus around liner 19. In one embodiment, it is a type that is releasable from wiper plug extension 149 and may be pumped down to and latched at a point near the bottom of liner 19 (FIG. 1). Alternately, it could be conveyed by drill pipe or other means to a point near the bottom of liner 19. Cement retainer 151 could comprise a member that has a check valve to prevent back flow of cement. If so, it could have a frangible burst disk to enable it to be pumped down. Alternately, as shown in FIG. 13, cement retainer could comprise a member that does not have a valve.

Figure 13:
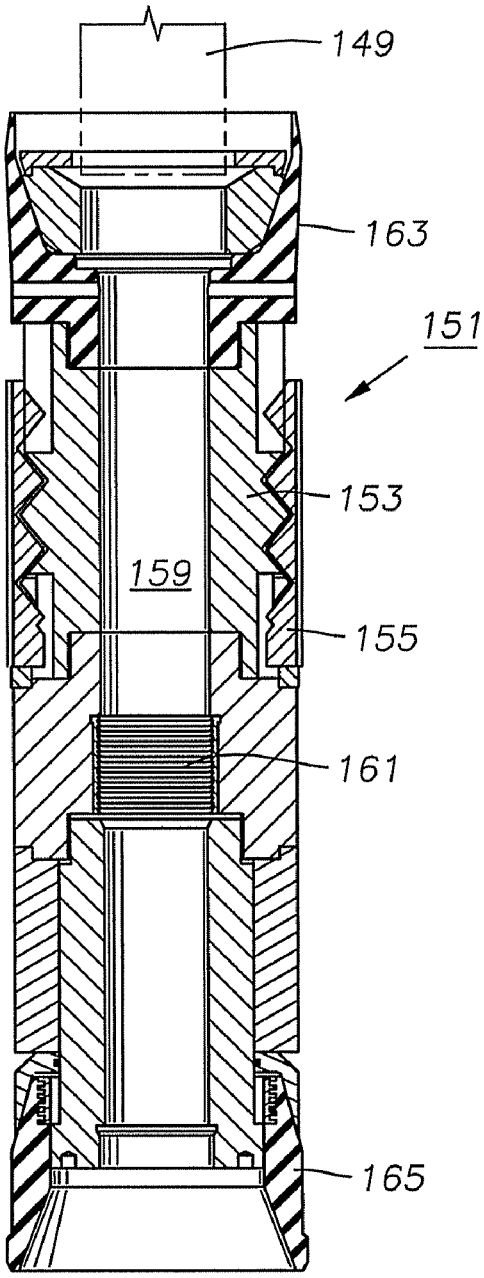
FIG. 13 is an enlarged sectional view of a cement retainer carried by the cementing string of FIGS. 12A and 12B.
Figure 14:
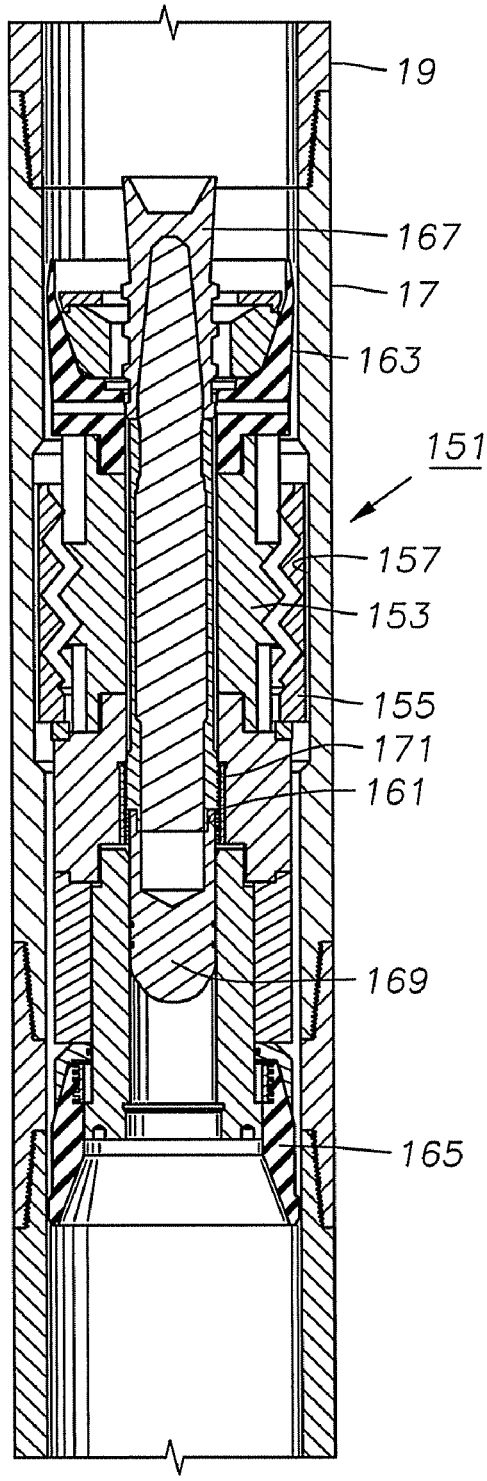
FIG. 14 is a sectional view of the cement retainer of FIG. 13, shown landed in a shoe joint located at the lower end of the liner string of the system of FIG. 1.

In the example of FIG. 13, cement retainer 151 has a tubular body 153 with a latching collar 155, which is adapted to spring outward and engage an annular recess 157 as shown in FIG. 14. Recess 157 is located in shoe joint 17 at the lower end of liner 19. Cement retainer body 153 has an axial passage 159 with a series of serrations or grooves 161 in this example. An upper seal element 163 seals against the inner diameter of liner 19 and a lower seal element 165 also seals against liner 19. Upper seal 163 is shown as an upward-facing cup seal, and lower seal 165 as a downward-facing cup seal. The releasable connection of cement retainer 151 to wiper plug extension 149 may comprise a plurality of shear screws (not shown).

In one method, the operator pumps cement down conduit 125, which flows through cement retainer passage 159 while it is still near the upper end of liner 19 and attached to wiper plug extension 149. The cement flows down liner 19 and back up the outer annulus surrounding liner 19. After pumping a pre-calculated volume of cement, the operator drops a wiper plug 167 and pumps it down conduit 125 with a fluid such as water. Wiper plug 167 has a prong 169 extending downward from it. Prong 169 has a ratchet sleeve 171 formed on it intermediate its ends. Ratchet sleeve 171 enters grooves 161 and latches prong 169 within passage 159. Prong 169 has seals on its exterior that seal to the interior of passage 159, blocking flow through passage 159. Continued fluid pressure applied from the surface will shear the engagement of cement retainer 151 with wiper plug extension 149 (FIG. 12B), and convey both cement retainer 151 and wiper plug 167 to shoe joint 17 (FIG. 14) near the bottom of liner 19. As they move downward, cement retainer 151 and wiper plug 167 will push the column of cement from the interior of liner 19 out the lower end of outer string 13 and up the outer annulus. When cement retainer 151 reaches annular recess 157, collar 155 latches into annular recess 157. Cement retainer 151 and wiper plug 167 block the return flow of cement back up into liner 19.

In an alternate cementing method, the length of wiper plug extension 149 (FIG. 12B) is substantially the length of liner 19. This results in cement retainer 151 being conveyed by conduit 125 and wiper plug extension 149 to annular recess 157 in shoe joint 17, rather than be pumped down. Cement retainer 151 will latch in shoe joint 17 (FIG. 14) while packer 135 is still above liner hanger 25 (FIGS. 12A and 12B). In that instance, the cement would be pumped down conduit 125 and through cement retainer 151 after cement retainer 151 has latched into shoe joint 17. Following the cement, wiper plug 167 and prong 169 would be then pumped down conduit 125, wiper plug extension 149 and into latching and sealing engagement with cement retainer 151. The operator would then release its engagement of wiper plug extension 149 from cement retainer 151 and retrieve conduit 125 and wiper plug extension 149.

Figure 15A:
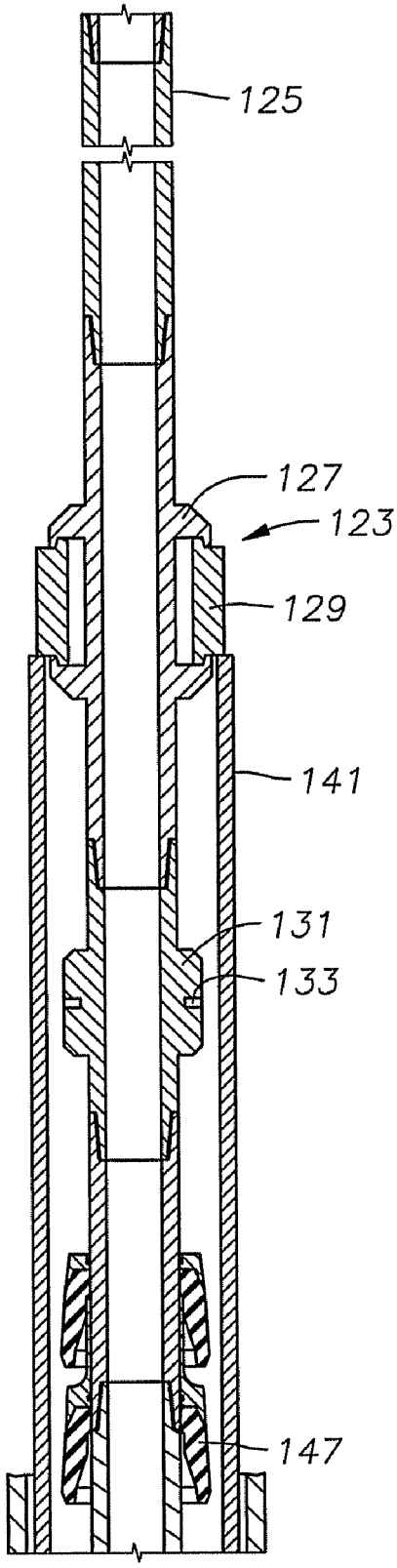
FIGS. 15A and 15B comprise a sectional view of the cementing string of FIGS. 12A and 12B shown in a position for setting the packer on the liner hanger of the system of FIG. 1.
Figure 15B:
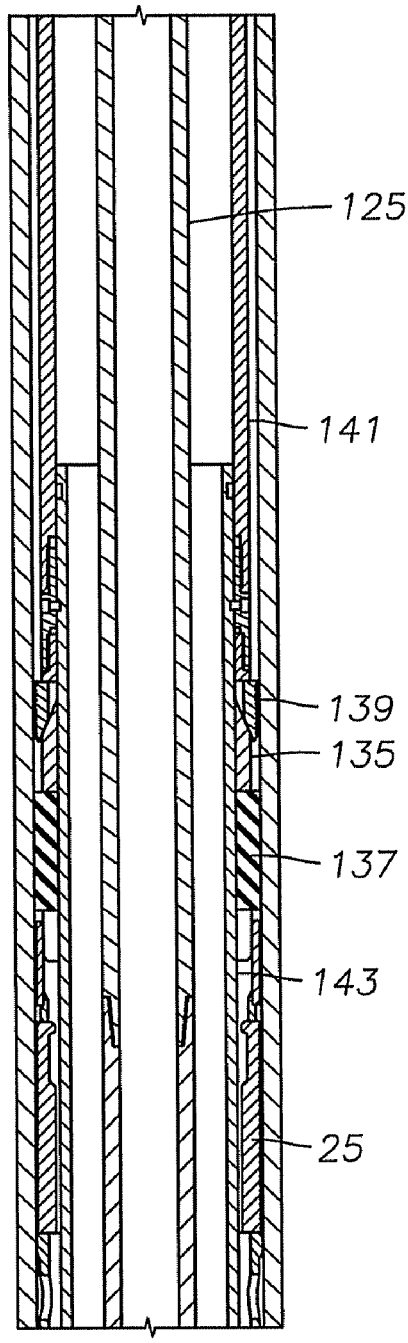

After the cement has been dispensed and cement retainer 151 set, the operator lowers conduit 125 to engage packer 135 with liner hanger 25 (FIGS. 12A and 12B). The operator releases packer running tool 131 from packer 135, such as by lowering conduit 125 to shear release mechanism 133 or by other methods. The operator then lifts conduit 125 until packer actuator 127 is located above the upper end of tieback receptacle 141, as shown in FIGS. 15A and 15B. When packer actuator 127 moves above tieback receptacle 141, lugs 129 spring outward. The operator then lowers conduit 125, which causes lugs 129 to bump against the upper end of tieback receptacle 141. The weight of conduit 125 applied to tieback receptacle 141 causes packer 137 to set against casing 11 as illustrated in FIG. 15B. The operator then retrieves the inner string to the surface.

While the invention has been shown in only a few of its forms, it should be apparent to those skilled in the art that it is not so limited but susceptible to various changes without departing from the scope of the invention.

The invention claimed is:

1. A method of drilling a well and installing a liner, comprising:

making up an inner string comprising drill pipe with a drill bit at secured to a lower end of the inner string and running the inner string into an outer string comprising a string of liner;

axially and rotationally latching the inner string to the outer string;

sealing between the inner and outer strings at an upper location near an upper end of the outer string and at a lower location near a lower end of the outer string to define a sealed annular chamber between the inner string and the outer string and between the upper and lower locations;

pumping drilling fluid down the inner string and out the drill bit; and communicating a portion of the drilling fluid flowing down the inner string to the annular chamber to pressurize the annular chamber.

2. The method according to claim 1, further comprising maintaining the pressure in the annular chamber while connecting additional sections of tubulars to the inner string.

3. The method according to claim 1, further comprising:

connecting a latch collar into the outer string proximal an upper end of the string of liner;

connecting a drilling latch into the inner string and axially and rotationally latching the drilling latch to the latch collar so as to transmit a rotational force to the string of liner proximal the upper end of the string of liner; and wherein the upper location is at the latch collar and drilling latch.

4. The method according to claim 1, comprising:

while pumping drilling fluid down the inner string, preventing drilling fluid diverted into the annular chamber from flowing out the annular chamber to an exterior of the outer string.

5. A method of drilling a well and installing a liner, comprising:

(a) assembling concentric inner and outer strings of tubulars, with a bottom hole assembly including a drill bit located at a lower end of the inner string and a string of liner with a liner hanger comprising the outer string;

(b) connecting a running tool to the liner hanger so that the running tool is incapable of transmitting drilling torque to the liner hanger and connecting the running tool to the inner string such that the running tool is capable of transmitting drilling torque to the inner string;

(c) lowering the inner and outer strings into the well and rotating the running tool to cause the inner string to rotate and drill the well, the rotation of the running tool creating a drilling torque in the inner string that is transmitted along the entire length of the inner string to the bottom hole assembly; wherein step (a) comprises:

connecting a latch collar into the outer string proximal an upper end of the string of liner; connecting a drilling latch into the inner string and axially and rotationally latching the drilling latch to the latch collar so as to transmit torque to the string of liner at the upper end of the string of liner; and mounting an internal stabilizer between the inner string and the outer string proximal a lower end of the outer string, the entire remaining portion of the inner string below the drilling latch being free of any axial and rotational connection to the string of liner.

6. A method of drilling a well and installing a liner, comprising:

(a) making up an inner string comprising drill pipe with a drill bit secured to a lower end of the inner string and running the inner string into an outer string comprising a string of liner;

(b) sealing between the inner and outer strings at axially spaced apart locations to define a sealed annular chamber between the inner and outer strings;

(c) rotating the drill bit and pumping drilling fluid down the inner string and out the drill bit to drill the well; and (d) diverting some of the drilling fluid flowing down the inner string to the annular chamber to apply a pressure to the annular chamber corresponding to a drilling fluid pump pressure.

7. The method according to claim 6, wherein:

step (b) comprises adding additional sections of drill pipe to the inner string as the well deepens; and step (c) comprises preventing the drilling fluid in the annular chamber from flowing back into the inner string while adding the additional sections of drill pipe.

8. The method according to claim 6, wherein:

step (a) comprises providing a port in the inner string for allowing drilling fluid to flow into the annular chamber, and mounting a check valve in the port; and preventing flow from the annular chamber back into the inner string with the check valve.

9. The method according to claim 6, wherein step (a) comprises sealing between the inner and outer strings at a point near a lower end of the string of liner and near an upper end of the string of liner, such that the annular chamber extends substantially the entire length of the string of liner.

10. A method of drilling a well and installing a liner, comprising:

(a) drilling and cementing a string of casing within a well;

(b) running a string of liner into the string of casing and suspending an upper end of the string of liner at a rig floor;

(c) connecting a bottom hole assembly that includes a drill bit secured to a string of drill pipe and running the bottom hole assembly through the string of liner;

(d) providing an upper outer assembly that includes a liner hanger and a profile nipple;

(e) mounting within the upper outer assembly an upper inner assembly that includes a drill lock tool in engagement with the profile nipple and a liner hanger control tool in engagement with the liner hanger;

(f) securing the upper outer assembly to the upper end of the string of liner, defining an outer string, and securing the upper inner assembly to the string of drill pipe, defining an inner string;

(g) lowering the inner and outer strings, rotating the drill bit and as the well is drilled deeper, and attaching additional sections of drill pipe to the inner string;

(h) retrieving the bottom hole assembly prior to reaching a selected depth by setting the liner hanger in the casing with the liner hanger control tool and retrieving the inner string while the outer string remains in the well; then (i) re-running the inner string into the outer string, releasing the liner hanger with the liner hanger control tool and continuing to rotate the drill bit to deepen the well; and (j) when at a selected depth, setting the liner hanger in the casing with the liner hanger control tool, retrieving the inner string, and cementing the string of liner.

11. The method according to claim 10, wherein rotating the drill bit in step (f) comprises rotating the inner string at least part of the time, and through the engagement of the drill lock tool with the profile nipple, causing the outer string to rotate with the inner string.

12. The method according to claim 10, wherein:

step (f) further comprises pumping drilling fluid down the inner string and out the drill bit; and the method further comprises:

sealing between the inner string at the outer string substantially over a length of the string of liner, defining an annular chamber; and communicating a portion of the drilling fluid flowing down the inner string to the annular chamber to pressurize the annular chamber.

13. The method according to claim 10, further comprising maintaining the pressure in the annular chamber while connecting the additional sections of drill pipe.

14. The method according to claim 10, wherein step (e) comprises axially and rotationally locking the drill lock tool to the profile nipple.

15. The method according to claim 10, wherein setting the liner hanger in step (g) comprises moving a portion of the liner hanger control tool axially relative to inner string in response to fluid pressure.

16. The method according to claim 15, wherein the fluid pressure to move the liner hanger control tool axially is provided by dropping a sealing element onto a seat in the liner hanger control tool, then pumping fluid down the inner string.

17. The method according to claim 10, wherein step (g) includes releasing the engagement of the drill lock tool with the profile nipple by moving a portion of the drill lock tool axially relative to the inner string in response to fluid pressure.

18. The method according to claim 10, wherein:

setting the liner hanger in step (g) comprises dropping a sealing element onto a seat in the liner hanger control tool, then pumping fluid down the inner string to move a portion of the liner hanger control tool axially; and step (g) further comprises releasing the engagement of the drill lock tool with the profile nipple by increasing the fluid pressure to move the sealing element from the seat in the liner hanger control tool onto a seat in the drill lock tool, the increased pressure moving a portion of the drill lock tool axially relative to the inner string.

19. The method according to claim 10, wherein cementing the string of liner in step (i) comprises:

attaching a packer to a cementing assembly that includes a packer actuator and a cement retainer, and on a string of conduit lowering the packer into engagement with the liner hanger and the cement retainer into the outer string;

conveying the cement retainer to a lower portion of the liner;

pumping the cement through the cement retainer and preventing backflow of cement with the cement retainer; and manipulating the conduit to cause the packer actuator to set the packer.

20. The method according to claim 19, wherein manipulating the conduit comprising applying weight to the packer with the packer actuator.

21. The method according to claim 10, wherein step (h) comprises:

selectively rotating the drill bit to deepen the well prior to engaging and releasing the liner hanger with the liner hanger control tool.

22. An apparatus for drilling a well and installing a liner, comprising:

a string of liner containing a profile nipple and a liner hanger with slips having a retracted and engaged position;

a string of conduit;

a flow control tool and a drill lock tool mounted to the string of conduit;

the flow control tool having an engaging member that controls movement of the slips of the liner hanger;

the drill lock tool having an axial locking element and a run-in position, a set position, and a released position, the locking element protruding from the drill lock tool into engagement with the profile nipple while the drill lock tool is in the set position and being retracted while the drill lock tool is in the run-in and released positions;

the drill lock tool being operable in response to rotation of the string of conduit to move the locking element from the run-in to the set position;

the flow control tool being operable in response to fluid pressure in the string of conduit to move the engaging member and the slips to the retracted position;

a seat in the flow control tool for receiving a sealing member conveyed down the inner string;

porting in the flow control tool that moves the engaging member and the slips to the engaged position in response to fluid pressure in the string of conduit at a first level after the sealing member is located on the seat;

a seat in the drill lock tool that receives the sealing member in response to fluid pressure in the string of conduit at a second level greater than the first level; and wherein the pressure at the second level moves the drill lock tool from the set position to the released position, enabling the string of conduit along with the flow control tool and the drill lock tool to be retrieved from the string of liner.

23. A method of drilling a well and installing a liner, comprising:

connecting a bottom hole assembly that includes a drill bit to a string of drill pipe and running the bottom hole assembly through a suspended string of liner;

latching the drill pipe to the upper end of the liner; wherein latching the drill pipe to the upper end of the liner comprises:

providing an upper outer assembly that includes a liner hanger and a profile nipple;

mounting within the upper outer assembly an upper inner assembly that includes a drill lock tool in engagement with the profile nipple and a liner hanger control tool in engagement with the liner hanger;

securing the upper outer assembly to the upper end of the string of liner, defining an outer string, and securing the upper inner assembly to the string of drill pipe, defining an inner string;

lowering the inner and outer strings, rotating the drill bit by rotating the drill pipe to transfer drilling torque to the bottom hole assembly without transmitting any drilling torque to the string of liner, and as the well is drilled deeper, attaching additional sections of drill pipe to the inner string;

if retrieving the bottom hole assembly is desired prior to reaching a selected depth, setting the liner hanger in the casing with the liner hanger control tool and retrieving the inner string while the outer string remains in the well; then re-running the inner string into the outer string, releasing the liner hanger with the liner hanger control tool and continuing to rotate the drill bit to deepen the well; and when at a selected depth, setting the liner hanger in the casing with the liner hanger control tool, retrieving the inner string, and cementing the string of liner.

24. A method of drilling a well and installing a liner, comprising:

(a) assembling an outer string including a string of liner with upper and lower ends, and connecting a latch collar into the outer string in proximity to one of the ends of the string of liner;

(b) assembling an inner string with components including a drilling latch, a stabilizer, and a bottom hole assembly with a drill bit, the components being rotationally connected to each other such that rotation imparted to an upper end of the inner string causes the bottom hole assembly to rotate;

(c) suspending the outer string, lowering the inner string into the outer string until the drill bit protrudes from the lower end, engaging the drilling latch with the latch collar, engaging an inner diameter of the outer string with the stabilizer in proximity to the other of the ends of the string of liner and in engagement with an inner diameter portion of the string of liner; and (d) imparting rotation to the upper end of the inner string, which causes rotation of the bottom hole assembly to drill the well, the rotation imparted to the upper end of the inner string also causing rotation of the outer string through the engagement of the drilling latch with the latch collar.

* * * * *